US009651035B2

(12) United States Patent
Suzuki et al.

(10) Patent No.: US 9,651,035 B2
(45) Date of Patent: May 16, 2017

(54) VARIABLE DISPLACEMENT SWASH PLATE TYPE COMPRESSOR

(71) Applicant: KABUSHIKI KAISHA TOYOTA JIDOSHOKKI, Aichi-ken (JP)

(72) Inventors: Takahiro Suzuki, Kariya (JP); Shinya Yamamoto, Kariya (JP); Hiroyuki Nakaima, Kariya (JP); Kazunari Honda, Kariya (JP); Kengo Sakakibara, Kariya (JP); Yusuke Yamazaki, Kariya (JP)

(73) Assignee: KABUSHIKI KAISHA TOYOTA JIDOSHOKKI, Aichi-Ken (JP)

( * ) Notice: Subject to any disclaimer, the term of this patent is extended or adjusted under 35 U.S.C. 154(b) by 283 days.

(21) Appl. No.: 14/626,083

(22) Filed: Feb. 19, 2015

(65) Prior Publication Data

US 2015/0267691 A1 Sep. 24, 2015

(30) Foreign Application Priority Data

Mar. 20, 2014 (JP) ..... 2014-057750

(51) Int. Cl.
*F04B 27/18* (2006.01)
*F04B 27/08* (2006.01)
(Continued)

(52) U.S. Cl.
CPC ..... *F04B 27/18* (2013.01); *F04B 27/0804* (2013.01); *F04B 27/0878* (2013.01);
(Continued)

(58) Field of Classification Search
CPC ..... F04B 27/1804; F04B 27/1054; F04B 2027/1809; F04B 2027/1822;
(Continued)

(56) References Cited

U.S. PATENT DOCUMENTS 4,037,993 A 7/1977 Roberts
4,061,443 A 12/1977 Black et al.
(Continued)

FOREIGN PATENT DOCUMENTS

EP 2 423 507 2/2012
JP 52-131204 11/1977
(Continued)

OTHER PUBLICATIONS

Extended European Search Report for 15155641.2 having a mailing date of Feb. 1, 2016.
(Continued)

*Primary Examiner* — Patrick Hamo
(74) *Attorney, Agent, or Firm* — Greenblum & Bernstein, P.L.C.

(57) ABSTRACT

A variable displacement swash plate type compressor includes a rotary shaft, a swash plate, and an actuator capable of changing the inclination angle of the swash plate. The actuator includes a movable body. The movable body includes a sliding portion that slides on the rotary shaft or the lug member and a movable body-side transmission portion that engages with the swash plate at a position radially outward of the rotational axis of the swash plate. The movable body-side transmission portion is configured such that a perpendicular line or a normal to the movable body-side transmission portion and the rotational axis of the rotary shaft intersect with each other in a zone surrounded by the sliding portion when viewed in a direction that is perpendicular to a direction in which the rotational axis of the rotary shaft extends and perpendicular to the first direction.

8 Claims, 8 Drawing Sheets

(51) Int. Cl.
*F04B 39/12* (2006.01)
*F04B 27/10* (2006.01)

(52) U.S. Cl.
CPC ..... *F04B 27/0895* (2013.01); *F04B 27/1054* (2013.01); *F04B 27/1072* (2013.01); *F04B 27/1804* (2013.01); *F04B 39/121* (2013.01)

(58) Field of Classification Search
CPC ..... F04B 2027/184; F04B 2027/1863; F04B 2027/1886; F04B 2027/1813; F04B 2027/1818; F04B 2027/1827; F04B 2027/1831; F04B 2027/1836; F04B 2027/1845; F04B 1/146
USPC ..... 417/222.1, 222.2
See application file for complete search history.

(56) References Cited

U.S. PATENT DOCUMENTS 5,259,736 A 11/1993 Terauchi
5,370,503 A 12/1994 Terauchi
6,398,516 B1 * 6/2002 Kawaguchi ..... F04B 27/1804 417/222.2
2003/0202885 A1 * 10/2003 Taguchi ..... F04B 27/1804 417/213
2003/0210989 A1 * 11/2003 Matsuoka ..... F04B 27/1036 417/222.2
2012/0073430 A1 3/2012 Uchikado
2013/0189121 A1 * 7/2013 Ota ..... F04B 27/16 417/53

FOREIGN PATENT DOCUMENTS

JP 08-105384 4/1996
KR 10-1993-0023598 12/1993

OTHER PUBLICATIONS

Official Action in KR Appl. No. 10-2015-0022240 dated Oct. 17, 2016.
U.S. Appl. No. 14/630,887 to Takahiro Suzuki et al., filed Feb. 25, 2015.

* cited by examiner

VARIABLE DISPLACEMENT SWASH PLATE TYPE COMPRESSOR

BACKGROUND OF THE INVENTION

The present invention relates to a variable displacement swash plate type compressor, in which pistons engaged with a swash plate are reciprocated by a stroke corresponding to the inclination angle of the swash plate.

Generally, when the pressure in a control pressure chamber of a variable displacement swash plate type compressor increases and approaches the pressure of the discharge pressure zone, the inclination angle of the swash plate decreases. This reduces the stroke of the pistons, and the displacement is decreased, accordingly. In contrast, when the pressure in a control pressure chamber decreases and approaches the pressure of the suction pressure zone, the inclination angle of the swash plate increases. This increases the stroke of the pistons, and the displacement is increased, accordingly. The variable displacement swash plate type compressor includes a displacement control valve. The displacement control valve controls the pressure in the control pressure chamber.

For example, Japanese Laid-Open Patent Publication No. 52-131204 discloses a compressor having a movable body that moves along the axis of the rotary shaft to change the inclination angle of the swash plate. As control gas is introduced to the control pressure chamber in the housing, the pressure inside the control pressure chamber is changed. This moves the movable body along the axis of the rotary shaft. As the movable body is moved along the axis of the rotary shaft, the movable body applies to a central portion of the swash plate a force that changes the inclination angle of the swash plate. As a result, the inclination angle of the swash plate is changed. Since the control pressure chamber is a small space compared to the swash plate chamber, only a small amount of refrigerant gas needs to be introduced to the control pressure chamber. This improves the response of change in the inclination angle of the swash plate. As a result, the inclination angle of the swash plate is smoothly changed, and the amount of refrigerant gas introduced to the inside of the control pressure chamber is not unnecessarily increased.

The swash plate has a top-dead-center corresponding part, which puts pistons at the top dead center.

Consideration will now be given to a structure for transmitting force that changes the inclination angle of a swash plate from a movable body to a part of the swash plate that is close to the top-dead-center corresponding part for the pistons. According to this configuration, if the range of changes in the inclination angle of the swash plate is the same, the movement distance of the movable body along the axis of the rotary shaft when the inclination angle of the swash plate is changed is small compared to the compressor of the above mentioned publication, in which the force that changes the inclination angle of the swash plate is transmitted from the movable body to the central part of the swash plate. This allows the axial size of the variable displacement swash plate type compressor to be reduced.

However, in the configuration in which the movable body applies a force for changing the inclination angle of the swash plate to the part of the swash plate that is close to the top-dead-center corresponding part for the pistons, a change in the inclination angle of the swash plate causes the movable body to receive a moment that acts to tilt the movable body with respect to the moving direction. If the movable body tilts with respect to the moving direction, a force that supports the tilting motion of the movable body is generated between the movable body and the rotary shaft while the movable body and the rotary shaft are contacting each other at two contact points on the opposite sides of the rotary shaft. The friction caused by the force generates a twist between the movable body and the rotary shaft. The twist increases the sliding resistance, hindering smooth movement of the movable body along the axis of the rotary shaft. This hampers smooth change in the inclination angle of the swash plate.

SUMMARY OF THE INVENTION

Accordingly, it is an objective of the present invention to provide a variable displacement swash plate type compressor that is capable of smoothly changing the inclination angle of the swash plate.

To achieve the foregoing objective and in accordance with one aspect of the present invention, a variable displacement swash plate type compressor is provided that includes a housing, a rotary shaft, a swash plate, a link mechanism, a piston, a conversion mechanism, an actuator and a control mechanism. The housing has a suction chamber, a discharge chamber, a swash plate chamber communicating with the suction chamber, and a cylinder bore. The rotary shaft is rotationally supported by the housing and has a rotational axis. The swash plate is rotational in the swash plate chamber by rotation of the rotary shaft. The link mechanism is arranged between the rotary shaft and the swash plate and allows change of an inclination angle of the swash plate with respect to a first direction that is perpendicular to the rotational axis of the rotary shaft. The piston is reciprocally received in the cylinder bore. The conversion mechanism causes the piston to reciprocate in the cylinder bore by a stroke corresponding to the inclination angle of the swash plate through rotation of the swash plate. The actuator is located in the swash plate chamber and capable of changing the inclination angle. The control mechanism controls the actuator. The link mechanism includes a lug member and a swash plate arm. The lug member is located in the swash plate chamber and is fixed to the rotary shaft and faces the swash plate. The swash plate arm transmits rotation of the rotary shaft from the lug member to the swash plate. The actuator includes the lug member, a movable body, and a control pressure chamber. The movable body is located between the lug member and the swash plate and moves in a direction in which a rotational axis of the rotary shaft extends, thereby changing the inclination angle. The control pressure chamber is defined by the lug member and the movable body and uses the internal pressure thereof to move the movable body. The movable body includes a sliding portion and a movable body-side transmission portion. The sliding portion slides on the rotary shaft or on the lug member as the sliding portion moves in a direction in which the rotational axis of the rotary shaft extends. The movable body-side transmission portion engages with the swash plate at a position radially outward of the rotational axis of the swash plate. The swash plate includes a swash plate-side transmission portion that engages with the movable body-side transmission portion. The movable body-side transmission portion is configured such that a perpendicular line or a normal to the movable body-side transmission portion and the rotational axis of the rotary shaft intersect with each other in a zone surrounded by the sliding portion when viewed in a direction that is perpendicular to a direction in which the rotational axis of the rotary shaft extends and perpendicular to the first direction.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

First Embodiment

A variable displacement swash plate type compressor 10 according to a first embodiment will now be described with reference to FIGS. 1 to 5. The variable displacement swash plate type compressor is used in a vehicle air conditioner.

Figure 1:
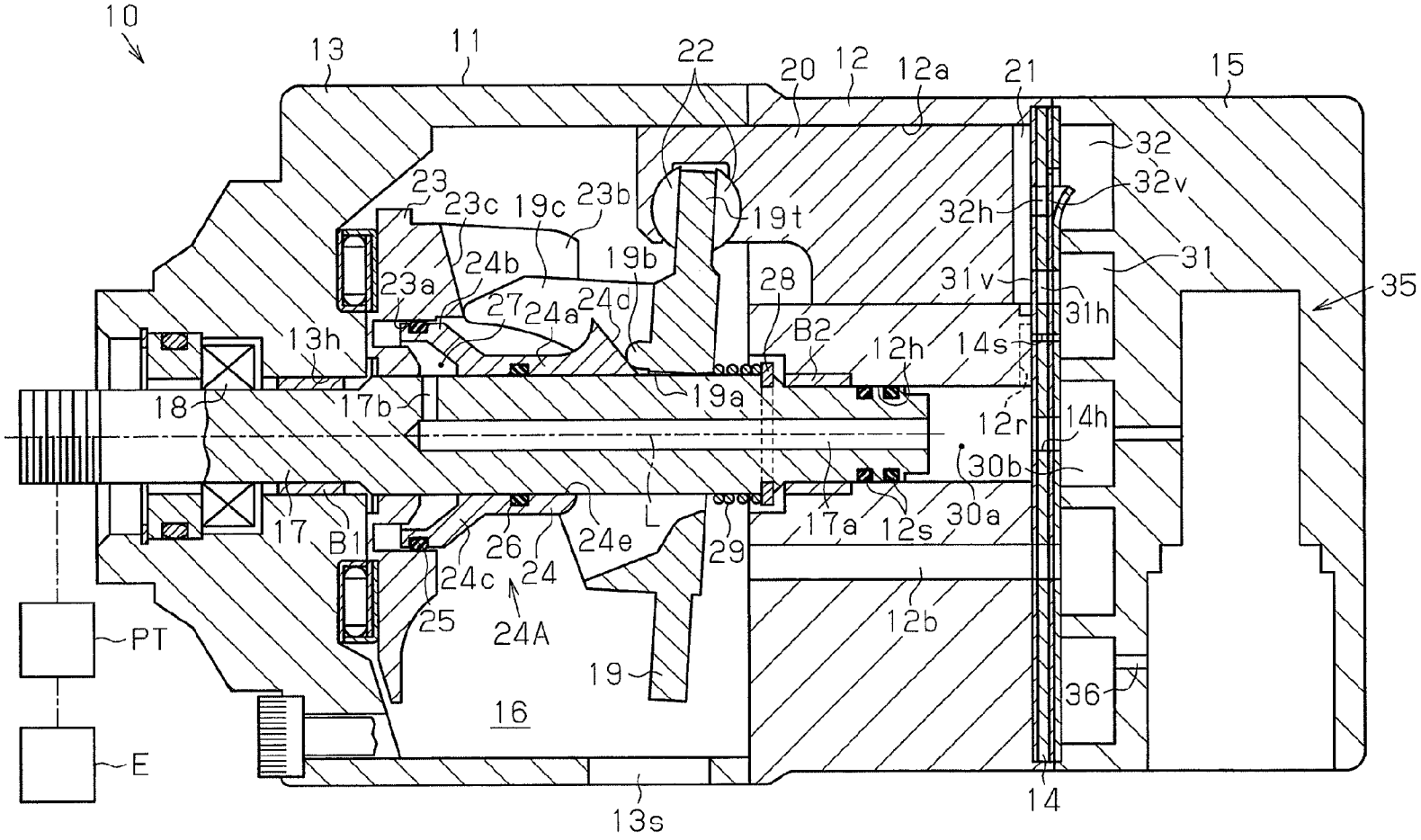
FIG. 1 is a cross-sectional side view illustrating a variable displacement swash plate type compressor according to a first embodiment.

As shown in FIG. 1, the variable displacement swash plate type compressor 10 includes a housing 11, which is formed by a cylinder block 12, a front housing member 13, and a rear housing member 15. The front housing member 13 is secured to one end (left end as viewed in FIG. 1) of the cylinder block 12. The rear housing member 15 is secured to the other end (right end as viewed in FIG. 1) of the cylinder block 12 with a valve assembly 14 in between. In the housing 11, the cylinder block 12 and the front housing member 13 define in between a swash plate chamber 16.

A rotary shaft 17 is rotationally supported in the housing 11. A part of the rotary shaft 17 on the front side (first side) extends through a shaft hole 13*h*, which is formed to extend through the front housing member 13. Specifically, the front part of the rotary shaft 17 refers to a part of the rotary shaft 17 that is located on the first side in the direction along the rotational axis L of the rotary shaft 17 (the axial direction of the rotary shaft 17). The front end of the rotary shaft 17 projects from the front housing member 13. A part of the rotary shaft 17 on the rear side (second side) extends through a shaft hole 12*h*, which is formed in the cylinder block 12. Specifically, the rear part of the rotary shaft 17 refers to a part of the rotary shaft 17 that is located on the second side in the direction in which the rotational axis L of the rotary shaft 17 extends.

A first plain bearing B1 is arranged in the shaft hole 13*h*. The front end of the rotary shaft 17 is rotationally supported by the front housing member 13 via the first plain bearing B1. A second plain bearing B2 is arranged in the shaft hole 12*h*. The rear end of the rotary shaft 17 is rotationally supported by the cylinder block 12 via the second plain bearing B2. A sealing device 18 of lip seal type is located between the front housing member 13 and the rotary shaft 17. The front end of the rotary shaft 17 is connected to and driven by an external drive source, which is a vehicle engine E in this embodiment, through a power transmission mechanism PT. In the present embodiment, the power transmission mechanism PT is a clutchless mechanism that constantly transmits power. The power transmission mechanism PT is, for example, a combination of a belt and pulleys.

Two seal rings 12*s* are located between the cylinder block 12 and the rotary shaft 17. In the shaft hole 12*h*, a first pressure regulating chamber 30*a* is formed between the valve assembly 14 and the rear end of the rotary shaft 17. The seal rings 12*s* seal the boundary between the first pressure regulating chamber 30*a* and the swash plate chamber 16.

The swash plate chamber 16 accommodates a swash plate 19, which rotates when receiving drive force from the rotary shaft 17. The swash plate 19 is also tilted along the axis L with respect to the rotary shaft 17. The swash plate 19 has an insertion hole 19*a*, through which the rotary shaft 17 extends. The swash plate 19 is assembled to the rotary shaft 17 by inserting the rotary shaft 17 into the insertion hole 19*a*.

The cylinder block 12 has cylinder bores 12*a* formed about the rotary shaft 17. Only one of the cylinder bores 12*a* is shown in FIG. 1. Each cylinder bore 12*a* extends through the cylinder block 12 in the axial direction. Each cylinder bore 12*a* accommodates a piston 20, which is allowed to move between a top dead center and a bottom dead center. Each cylinder bore 12*a* has two openings. One of the openings of each cylinder bore 12*a* is closed by the valve assembly 14, and the other opening is closed by the associated piston 20. A compression chamber 21 is defined inside each cylinder bore 12*a*. The volume of each compression chamber 21 changes as the corresponding piston 20 reciprocates.

Each piston 20 is engaged with the peripheral portion of the swash plate 19 via a pair of shoes 22. The shoes 22 convert rotation of the swash plate 19, which rotates with the rotary shaft 17, to linear reciprocation of the pistons 20. Thus, the pairs of the shoes 22 function as a conversion mechanism that reciprocates the pistons 20 in the cylinder bores 12*a* by rotation of the swash plate 19.

The valve assembly 14 and the rear housing member 15 define in between a suction chamber 31 and a discharge chamber 32, which surrounds the suction chamber 31. The valve assembly 14 has suction ports 31*h*, suction valve flaps 31*v* for opening and closing the suction ports 31*h*, discharge ports 32*h*, and discharge valve flaps 32*v* for opening and closing the discharge ports 32*h*. Each set of the suction port 31*h*, the suction valve flap 31*v*, the discharge port 32*h*, and the discharge valve flap 32*v* corresponds to one of the cylinder bores 12*a*. Each suction port 31*h* connects the suction chamber 31 to the corresponding cylinder bore 12*a* (the compression chamber 21). Each discharge port 32*h* connects the associated cylinder bore 12*a* (the compression chamber 21) to the discharge chamber 32.

Also, the valve assembly 14 and the rear housing member 15 define in between a second pressure regulating chamber 30*b*. The second pressure regulating chamber 30*b* is located in the central part of the rear housing member 15. The suction chamber 31 is located radially outside of the second pressure regulating chamber 30*b*. The valve assembly 14 has a communication hole 14*h*, which connects the first pressure regulating chamber 30*a* and the second pressure regulating chamber 30*b* with each other.

The swash plate chamber 16 and the suction chamber 31 are connected to each other by a suction passage 12*b*, which extends through the cylinder block 12 and the valve assembly 14. A suction inlet 13*s* is formed in the peripheral wall of the front housing member 13. The suction inlet 13*s* is connected to an external refrigerant circuit. Refrigerant gas is drawn into the swash plate chamber 16 from the external refrigerant circuit via the suction inlet 13*s* and is then drawn into the suction chamber 31 via the suction passage 12*b*. The suction chamber 31 and the swash plate chamber 16 therefore form a suction pressure zone. The pressure in the suction chamber 31 and the pressure in the swash plate chamber 16 are substantially the same.

A disk shaped lug member 23 is fixed to the rotary shaft 17 at a position forward of the swash plate 19. The lug member 23 faces the swash plate 19 and rotates integrally with the rotary shaft 17.

The swash plate chamber 16 accommodates an actuator 24A. The actuator 24A is capable of changing the inclination angle of the swash plate 19 with respect to a first direction (the vertical direction as viewed in FIG. 1), which is perpendicular to the rotational axis L of the rotary shaft 17 in the swash plate 19. The actuator 24A has a cylindrical movable body 24 with a closed end, which is located between the lug member 23 and the swash plate 19. The movable body 24 is movable in the swash plate chamber 16 and relative to the lug member 23 along the axis of the rotary shaft 17.

The movable body 24 is formed by a first cylindrical portion 24*a*, a second cylindrical portion 24*b*, and an annular coupling portion 24*c*.The first cylindrical portion 24*a* has an insertion hole 24*e*, through which the rotary shaft 17 extends. The second cylindrical portion 24*b* extends in the axial direction of the rotary shaft 17. The coupling portion 24*c*, which has a larger diameter than the first cylindrical portion 24*a*, couples the first cylindrical portion 24*a* and the second cylindrical portion 24*b* to each other. The distal end of the second cylindrical portion 24*b* is received in an annular insertion recess 23*a* formed in the lug member 23. A sealing member 25 seals the boundary between the outer circumferential surface of the second cylindrical portion 24*b* and the surface of the insertion recess 23*a* that faces the outer circumferential surface of the second cylindrical portion 24*b*. The second cylindrical portion 24*b* and the surface of the insertion recess 23*a* that faces the second cylindrical portion 24*b* are allowed to slide on each other via the sealing member 25. This allows the movable body 24 to rotate integrally with the rotary shaft 17 via the lug member 23.

Likewise, the clearance between the insertion hole 24*e* and the rotary shaft 17 is sealed by a sealing member 26. The actuator 24A has a control pressure chamber 27 defined by the lug member 23 and the movable body 24. That is, the lug member 23 forms a part of the actuator 24A.

The swash plate 19 has a top-dead-center corresponding part 19*t*, which puts each piston 20 at the top dead center. An arcuate swash plate-side transmission portion 19*b* is formed integrally with the swash plate 19 at a position that faces the movable body 24. The swash plate-side transmission portion 19*b* extends forward from the swash plate 19. With respect to the rotational axis L of the rotary shaft 17, the swash plate-side transmission portion 19*b* is located at a position close to the top-dead-center corresponding part 19*t*. A movable body-side transmission portion 24*d* is formed at a position in the first cylindrical portion 24*a* that faces the swash plate-side transmission portion 19*b*. The movable body-side transmission portion 24*d* engages with the swash plate-side transmission portion 19*b*. With respect to the rotational axis L of the rotary shaft 17, the movable body-side transmission portion 24*d* is located at a position close to the top-dead-center corresponding part 19*t* for the pistons 20. That is, the movable body-side transmission portion 24*d* engages with the swash plate 19 at a position radially outward of the rotational axis L of the swash plate 19. The swash plate-side transmission portion 19*b* engages with, that is contacts, the movable body-side transmission portion 24*d* and transmits force to or receives force from the movable body 24.

The lug member 23 has a pair of arms 23*b* extending toward the swash plate 19. The swash plate 19 has a swash plate arm 19*c* on the upper side (upper side as viewed in FIG. 1). The swash plate arm 19*c* protrudes toward the lug member 23. Rotation of the rotary shaft 17 is transmitted to the swash plate 19 via the lug member 23 and the swash plate arm 19*c*. The swash plate arm 19*c* is inserted between the two arms 23*b*. The swash plate arm 19*c* is movable between the arms 23*b* while being held between the arms 23*b*. A cam surface 23*c* is formed at the bottom between the arms 23*b*. The distal end of the swash plate arm 19*c* slides on the cam surface 23*c*.

The swash plate 19 is permitted to tilt in the axial direction of the rotary shaft 17 by cooperation of the swash plate arm 19*c* between the arms 23*b* and the cam surface 23*c*. This allows the drive force of the rotary shaft 17 to be transmitted to the swash plate arm 19*c* via the arms 23*b*, so that the swash plate 19 rotates. When the swash plate 19 is tilted in the axial direction of the rotary shaft 17, the swash plate arm 19*c* slides along the cam surface 23*c*. Thus, the lug member 23 and the swash plate arm 19*c* function as a link mechanism that allows the inclination angle of the swash plate 19 to be changed.

A stopper ring 28 is fixed to the rotary shaft 17 at a position close to the cylinder block 12 with respect to the swash plate 19. A spring 29, which is fitted about the rotary shaft 17, is located between the stopper ring 28 and the swash plate 19. The spring 29 urges the swash plate 19 such that the swash plate 19 tilts toward the lug member 23.

A first in-shaft passage 17*a* is formed in the rotary shaft 17. The first in-shaft passage 17*a* extends along the axis L of the rotary shaft 17. The rear end of the first in-shaft passage 17*a* is opened to the interior of the first pressure regulating chamber 30*a*. Also, a second in-shaft passage 17*b* is formed in the rotary shaft 17. The second in-shaft passage 17*b* extends in the radial direction of the rotary shaft 17. One end of the second in-shaft passage 17*b* communicates with the first in-shaft passage 17*a*. The other end of the second in-shaft passage 17*b* is opened to the interior of the control pressure chamber 27. Accordingly, the control pressure chamber 27 and the first pressure regulating chamber 30*a* are connected to each other by the first in-shaft passage 17*a* and the second in-shaft passage 17*b*.

The valve assembly 14 has a restricting portion 14*s*, which extends through the valve assembly 14 and communicates with the suction chamber 31. The cylinder block 12 has a communication portion 12*r* in an end face that faces the valve assembly 14. The communication portion 12*r* connects the first pressure regulating chamber 30*a* and the restricting portion 14*s* to each other. The control pressure chamber 27 and the suction chamber 31 are connected to each other via the second in-shaft passage 17*b*, the first in-shaft passage 17*a*, the first pressure regulating chamber 30*a*, the communication portion 12*r*, and the restricting portion 14*s*.

The pressure in the control pressure chamber 27 is controlled by introducing refrigerant gas from the discharge chamber 32 to the control pressure chamber 27 and discharging refrigerant gas from the control pressure chamber 27 to the suction chamber 31. Thus, the refrigerant gas supplied to the control pressure chamber 27 serves as control gas for controlling the pressure in the control pressure chamber 27. The pressure difference between the control pressure chamber 27 and the swash plate chamber 16 causes the movable body 24 to move along the axis of the rotary shaft 17 with respect to the lug member 23. The rear housing member 15 has an electromagnetic displacement control valve 35, which serves as a control mechanism for controlling the actuator 24A. The displacement control valve 35 is located in a communication passage 36, which connects the discharge chamber 32 to the second pressure regulating chamber 30*b*.

Figure 2:
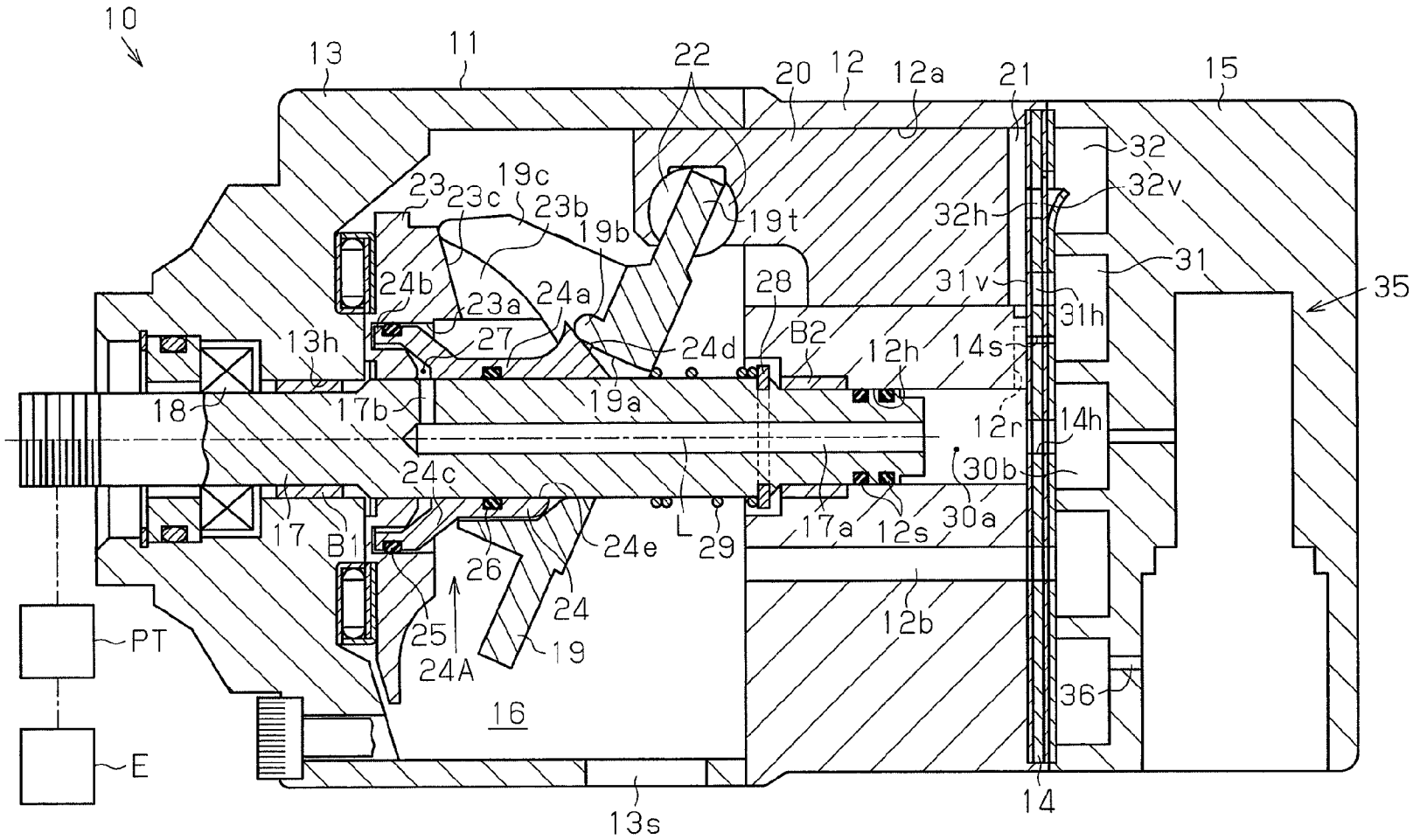
FIG. 2 is a cross-sectional side view illustrating the variable displacement swash plate type compressor when the swash plate is at the maximum inclination angle.

In the variable displacement swash plate type compressor 10, which has the above described structure shown in FIG. 2, reduction in the opening degree of the displacement control valve 35 reduces the flow rate of refrigerant gas that is delivered to the control pressure chamber 27 from the discharge chamber 32 via the communication passage 36, the second pressure regulating chamber 30*b*, the communication hole 14*h*, the first pressure regulating chamber 30*a*, the first in-shaft passage 17*a*, and the second in-shaft passage 17*b*. Then, the refrigerant gas is discharged from the control pressure chamber 27 to the suction chamber 31 via the second in-shaft passage 17*b*, the first in-shaft passage 17*a*, the first pressure regulating chamber 30*a*, the communication portion 12*r*, and the restricting portion 14*s*, so that the pressure in the control pressure chamber 27 approaches the pressure in the suction chamber 31.

When the pressure in the control pressure chamber 27 approaches the pressure in the suction chamber 31 so that the pressure difference between the control pressure chamber 27 and the swash plate chamber 16 is decreased, the movable body 24 is moved such that the first cylindrical portion 24*a* approaches the lug member 23. Then, the swash plate 19 is urged toward the lug member 23 by the force of the spring 29, so that the swash plate arm 19*c* slides on the cam surface 23*c* and away from the rotary shaft 17. This increases the inclination angle of the swash plate 19 and thus increases the stroke of the pistons 20. Accordingly, the displacement is increased.

As shown in FIG. 1, increase in the opening degree of the displacement control valve 35 increases the flow rate of refrigerant gas that is delivered to the control pressure chamber 27 from the discharge chamber 32 via the communication passage 36, the second pressure regulating chamber 30*b*, the communication hole 14*h*, the first pressure regulating chamber 30*a*, the first in-shaft passage 17*a*, and the second in-shaft passage 17*b*. This causes the pressure in the control pressure chamber 27 to approach that in the discharge chamber 32.

When the pressure in the control pressure chamber 27 approaches the pressure in the discharge chamber 32, the pressure difference between the control pressure chamber 27 and the swash plate chamber 16 is increased. Accordingly, the movable body 24 is moved such that the first cylindrical portion 24*a* of the movable body 24 moves away from the lug member 23. Then, the movable body-side transmission portion 24*d* presses the swash plate-side transmission portion 19*b* at a position on the swash plate 19 that is close to the top-dead-center corresponding part 19*t* for the pistons 20. Thus, the swash plate 19 is pushed by the force of the spring 29 in a direction away from the lug member 23. The swash plate arm 19*c* slides on the cam surface 23*c* toward the rotary shaft 17 to reduce the inclination angle of the swash plate 19. This reduces the stroke of the pistons 20, and the displacement is reduced, accordingly.

Figure 3:
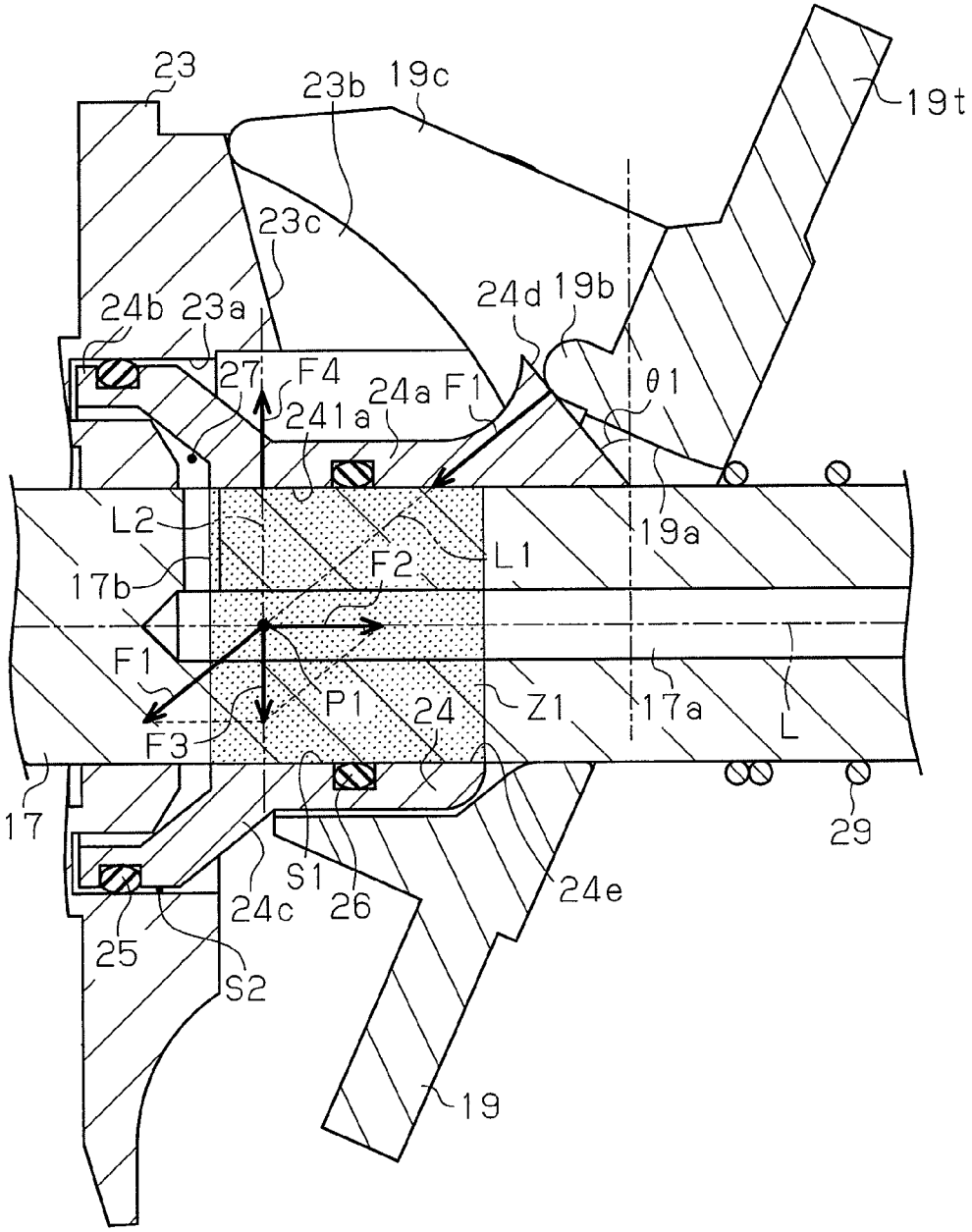
FIG. 3 is an enlarged cross-sectional side view illustrating the movable body and its surrounding when the inclination angle of the swash plate is maximized.

As shown in FIG. 3, the movable body 24 has a sliding portion 241*a*, which slides along the rotary shaft 17 as the movable body 24 moves along the axis of the rotary shaft 17.

In the present embodiment, a clearance S1 between the inner circumferential surface of the first cylindrical portion 24*a* and the rotary shaft 17 is smaller than a clearance S2 between the outer circumferential surface of the second cylindrical portion 24*b* and the insertion recess 23*a*. Therefore, the sliding portion 241*a* is the inner circumferential surface of the first cylindrical portion 24*a* and extends along the axis of the rotary shaft 17.

The movable body-side transmission portion 24*d* is shaped as a linearly extending flat surface, which is inclined with respect to the moving direction of the movable body 24. The movable body-side transmission portion 24*d* extends linearly and separates away from the swash plate 19 as the distance from the rotational axis L of the rotary shaft 17 increases.

Suppose that the swash plate 19 has changed its inclination angle to the angle shown in FIG. 3. The point at which a perpendicular line L1 to the movable body-side transmission portion 24*d* intersects the rotational axis L of the rotary shaft 17 is defined as an intersection P1. The perpendicular line L1 matches with the direction of a force F1 that is applied to the movable body-side transmission portion 24*d* by the swash plate-side transmission portion 19*b*. The inclination θ1 of the movable body-side transmission portion 24*d* is determined such that, when the inclination angle of the swash plate 19 is maximized, the intersection P1 is located in a zone Z1 surrounded by the sliding portion 241*a* when viewed in a direction that is perpendicular to the rotational axis L of the rotary shaft 17 and perpendicular to the first direction (that is, as viewed in the direction that is perpendicular to the sheet of FIG. 3 and directed away from the viewer). The inclination θ1 refers to an inclination with respect to the direction perpendicular to the axis of the rotary shaft 17. The zone Z1 is surrounded by the sliding portion 241*a* in the axial direction of the rotary shaft 17 and is the dotted region in FIG. 3.

Figure 4:
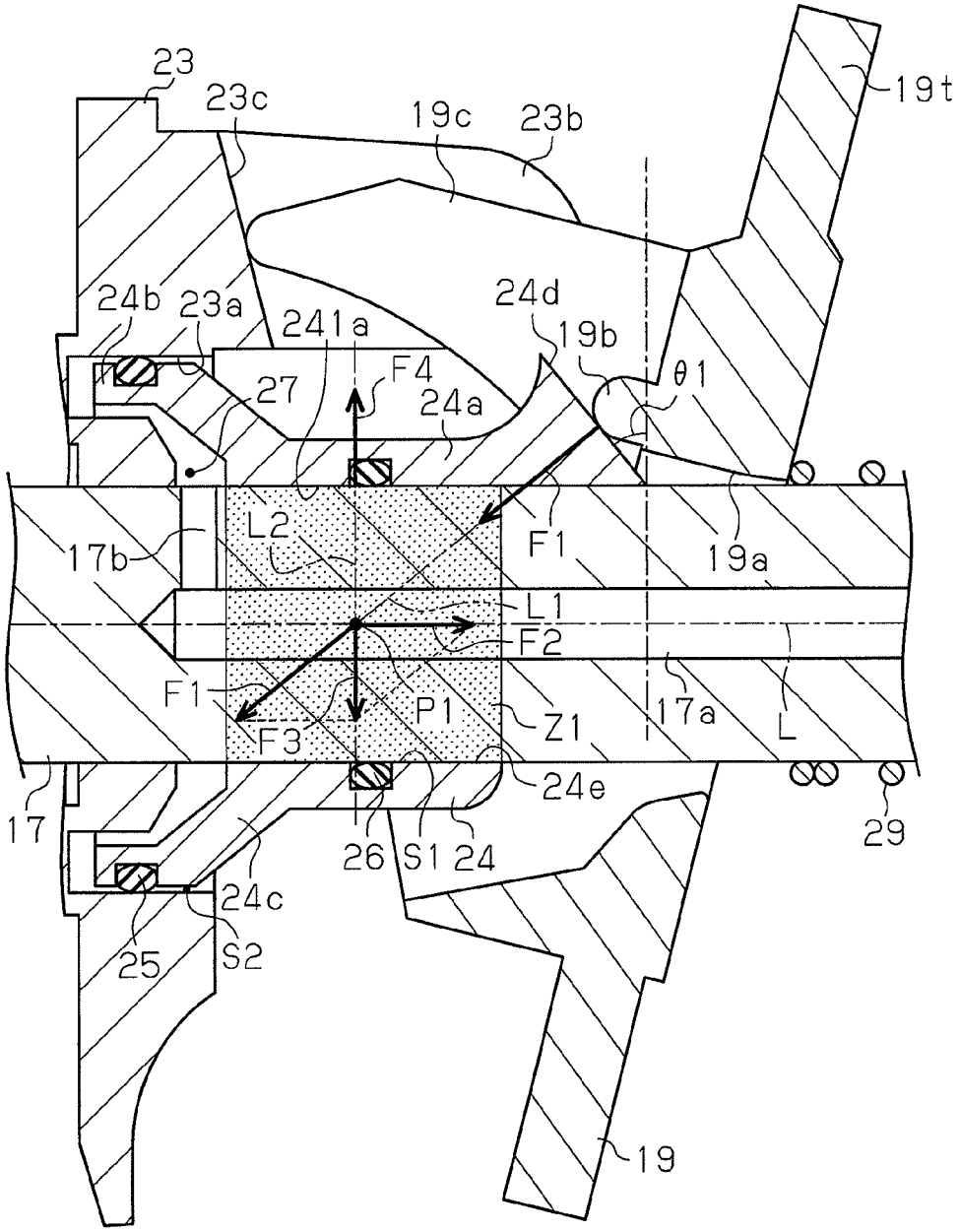
FIG. 4 is an enlarged cross-sectional side view illustrating the movable body and its surrounding when the inclination angle of the swash plate is between the minimized inclination angle and the maximized inclination angle.

As shown in FIG. 4, the inclination θ1 of the movable body-side transmission portion 24*d* is determined such that, when the inclination angle of the swash plate 19 is between the minimum inclination angle and the maximum inclination angle, the intersection P1 is located in the zone Z1, which is surrounded by the sliding portion 241*a*, when viewed in a direction that is perpendicular to the rotational axis L of the rotary shaft 17 and perpendicular to the first direction.

Figure 5:
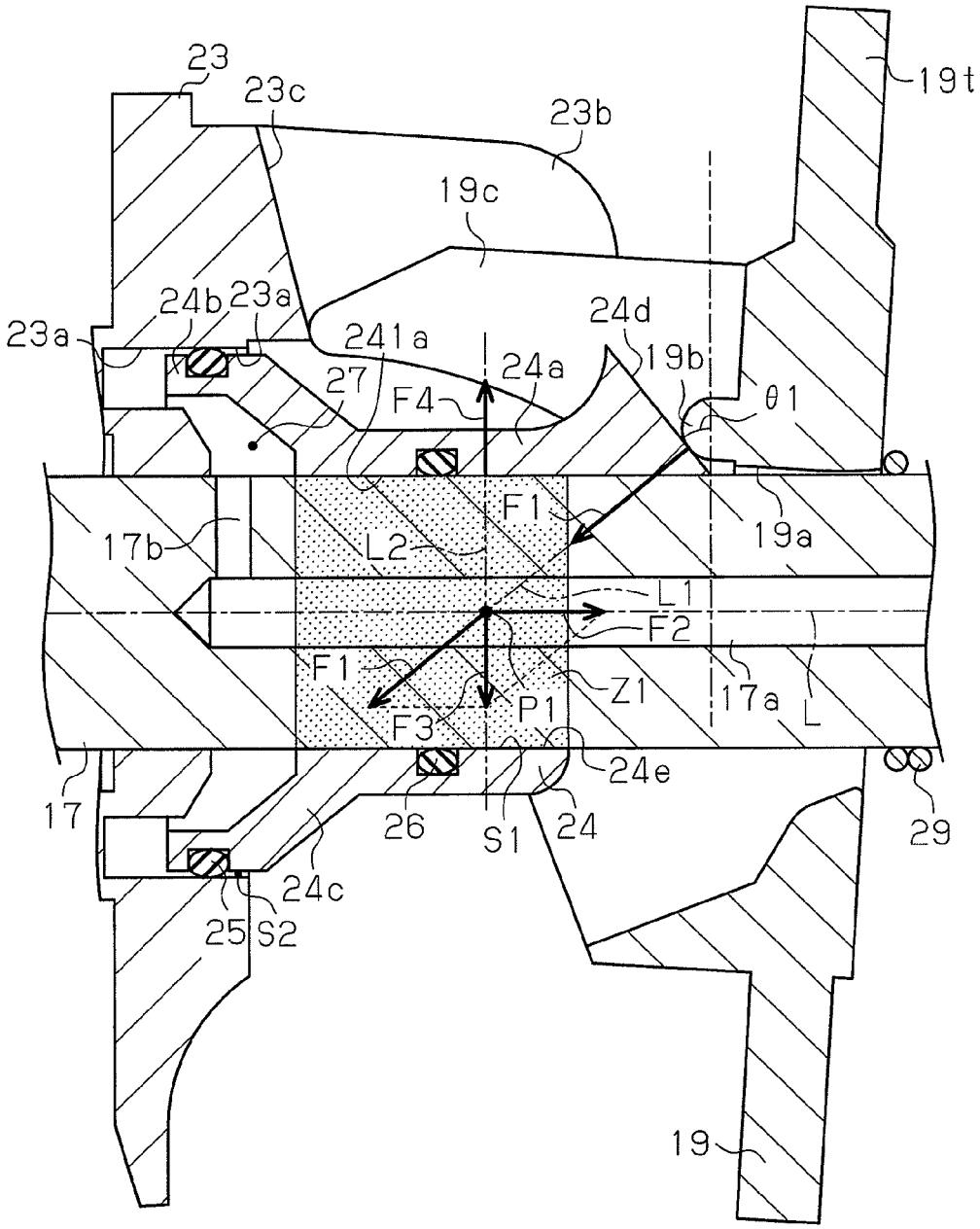
FIG. 5 is an enlarged cross-sectional side view illustrating the movable body and its surrounding when the inclination angle of the swash plate is minimized.

As shown in FIG. 5, the inclination 91 of the movable body-side transmission portion 24*d* is determined such that, when the inclination angle of the swash plate 19 is minimized, the intersection P1 is located in the zone Z1, which is surrounded by the sliding portion 241*a*, when viewed in a direction that is perpendicular to the rotational axis L of the rotary shaft 17 and perpendicular to the first direction. That is, in the present embodiment, the inclination el of the movable body-side transmission portion 24*d*, that is, the shape of the movable body-side transmission portion 24*d* is determined such that the intersection P1 is located in the zone Z1, which is surrounded by the sliding portion 241*a*, in the entire range of change in the inclination angle of the swash plate 19.

Operation of the first embodiment will now be described.

The intersection P1 is located in the zone Z1 surrounded by the sliding portion 241*a*, at which the rotary shaft 17 and the movable body 24 slide on each other in the axial direction of the rotary shaft 17 as the inclination angle of the swash plate 19 changes. At this time, a resultant force is generated by combining the force F1, which is applied to the movable body-side transmission portion 24*d* by the swash plate-side transmission portion 19*b*, a force F2 that is generated by the pressure in the control pressure chamber 27 and acts to move the movable body 24 along the axis of the rotary shaft 17. The resultant force is defined as a resultant force F3. The resultant force F3 is generated on a vertical line L2 including the intersection P1, and a force F4 that is in the opposite direction and balances with the resultant force F3 is also generated on the vertical line L2. As a result, all the forces acting on the movable body 24 are generated on the vertical line L2, which includes the intersection P1, and balance out, and no moment is generated that acts to tilt the movable body 24 with respect to the moving direction. Thus, the inclination angle of the swash plate 19 is changed smoothly.

The movable body-side transmission portion 24*d* is designed such that, when the swash plate 19 is at the maximum inclination angle, the intersection P1 is located in the zone Z1, which is surrounded by the sliding portion 241*a*.

Therefore, at the maximum inclination angle, or when the movable body 24 generates the greatest drive force, no moment is generated that acts to tilt the movable body 24 with respect to the moving direction. As a result, the inclination angle of the swash plate 19 is readily maximized. Also, the inclination angle of the swash plate 19 is decreased smoothly from the maximum inclination angle.

The movable body-side transmission portion 24*d* is configured such that, when the swash plate 19 is between the minimum inclination angle and the maximum inclination angle, the intersection P1 is located in the zone Z1, which is surrounded by the sliding portion 241*a*. This allows the movable body 24 to move smoothly between the maximum inclination angle and the minimum inclination angle, which is most frequently used. The flow rate control of refrigerant gas introduced into the control pressure chamber 27 is simplified, accordingly.

The movable body-side transmission portion 24*d* is designed such that, when the swash plate 19 is at the minimum inclination angle, the intersection P1 is located in the zone Z1, which is surrounded by the sliding portion 241*a*. Therefore, at the minimum inclination angle of the swash plate 19, no moment is generated that acts to tilt the movable body 24 with respect to the moving direction. As a result, the inclination angle of the swash plate 19 is increased smoothly when the variable displacement swash plate type compressor 10 starts operating.

The first embodiment achieves the following advantages.

(1) The movable body-side transmission portion 24*d* is configured such that the perpendicular line L1 to the movable body-side transmission portion 24*d* and the rotational axis L of the rotary shaft 17 intersect with each other in the zone Z1, which is surrounded by the sliding portion 241*a*, when viewed in a direction that is perpendicular to the rotational axis L of the rotary shaft 17 and perpendicular to the first direction.

According to this configuration, when the inclination angle of the swash plate 19 is changed, the intersection P1 of the perpendicular line L1 to the movable body-side transmission portion 24*d* and the rotational axis L of the rotary shaft 17 is located in the zone Z1, which is surrounded by the sliding portion 241*a*, in the axial direction of the rotary shaft 17. The perpendicular line L1 matches with the direction of the force F1, which is applied to the movable body-side transmission portion 24*d* by the swash plate-side transmission portion 19*b*.

At this time, a resultant force is generated by combining the force F1, which is applied to the movable body-side transmission portion 24*d* by the swash plate-side transmission portion 19*b*, a force F2 that is generated by the pressure in the control pressure chamber 27 and acts to move the movable body 24 along the axis of the rotary shaft 17. The resultant force is denoted by F3. The resultant force F3 is generated on a vertical line L2 including the intersection P1, and a force F4 that is in the opposite direction and balances with the resultant force F3 is also generated on the vertical line L2. As a result, all the forces acting on the movable body 24 are generated on the vertical line L2, which includes the intersection P1, and balance out, and no moment is generated that acts to tilt the movable body 24 with respect to the moving direction. Therefore, the inclination angle of the swash plate 19 is changed smoothly.

(2) The movable body-side transmission portion 24*d* is configured such that, when the swash plate 19 is at the maximum inclination angle, the intersection P1 is located in the zone Z1, which is surrounded by the sliding portion 241*a*. Therefore, at the maximum inclination angle, or when the movable body 24 generates the greatest drive force, no moment is generated that acts to tilt the movable body 24 with respect to the moving direction. As a result, the inclination angle of the swash plate 19 is readily maximized. Also, the inclination angle of the swash plate 19 is decreased smoothly from the maximum inclination angle.

(3) The movable body-side transmission portion 24*d* is configured such that, when the swash plate 19 is at the minimum inclination angle, the intersection P1 is located in the zone Z1, which is surrounded by the sliding portion 241*a*. Therefore, at the minimum inclination angle of the swash plate 19, no moment is generated that acts to tilt the movable body 24 with respect to the moving direction. As a result, the inclination angle of the swash plate 19 is increased smoothly when the variable displacement swash plate type compressor 10 starts operating.

(4) The movable body-side transmission portion 24*d* is configured such that, when the swash plate 19 is between the minimum inclination angle and the maximum inclination angle, the intersection P1 is located in the zone Z1, which is surrounded by the sliding portion 241*a*. This allows the movable body 24 to move smoothly between the maximum inclination angle and the minimum inclination angle, which is most frequently used in the variable displacement swash plate type compressor 10. Thus, the flow rate control of refrigerant gas introduced into the control pressure chamber 27 is simplified.

(5) The movable body-side transmission portion 24*d* is shaped as a linearly extending flat surface, which is inclined with respect to the moving direction of the movable body 24. This allows the shape of the movable body-side transmission portion 24*d* to be simplified. Thus, the movable body-side transmission portion 24*d* does not need to have a complicated shape for reducing the moment that acts to tilt the movable body 24 with respect to the moving direction. It is thus possible to improve the productivity.

(6) The movable body-side transmission portion 24*d* presses the swash plate-side transmission portion 19*b* at a position on the swash plate 19 that is close to the top-dead-center corresponding part 19*t* for the pistons 20, thereby reducing the inclination angle of the swash plate 19. This reduces the movement distance of the movable body 24 along the axis of the rotary shaft 17 compared to the configuration in which the force that changes the inclination angle of the swash plate 19 is transmitted from the movable body 24 to the central part of the swash plate 19. Therefore, the axial size of the variable displacement swash plate type compressor 10 is reduced.

Second Embodiment

A variable displacement swash plate type compressor according to a second embodiment will now be described with reference to FIG. 6. In the embodiments described below, the same reference numerals are given to those components that are the same as the corresponding components of the first embodiment, which has already been described, and explanations are omitted or simplified.

Figure 6:
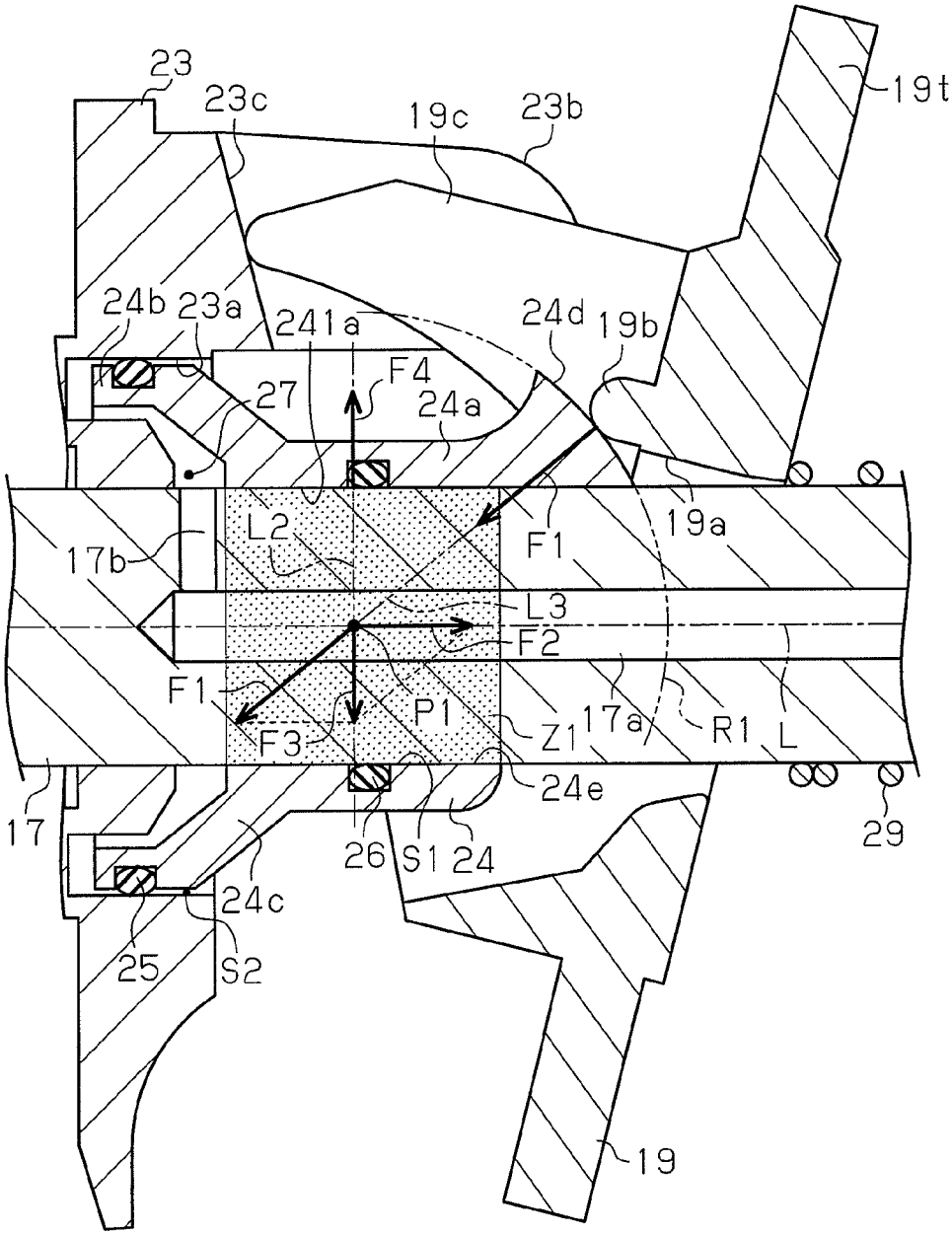
FIG. 6 is a cross-sectional side view illustrating a movable body and its surrounding according to a second embodiment.

As shown in FIG. 6, the movable body-side transmission portion 24*d* has an arcuate shape the center of which is a point on the rotational axis L of the rotary shaft 17. The movable body-side transmission portion 24*d* is aligned with an imaginary circle R1 the center of which is a point on the rotational axis L of the rotary shaft 17. When the inclination angle of the swash plate 19 is changed, the intersection P1 of a normal L3 to the movable body-side transmission portion 24*d* and the rotational axis L of the rotary shaft 17 is located in the zone Z1, which is surrounded by the sliding portion 241*a*. The normal L3 matches with the direction of the force F1 that is applied to the movable body-side transmission portion 24*d* by the swash plate-side transmission portion 19*b*. The intersection P1 coincides with the central point of the imaginary circle R1. That is, the movable body-side transmission portion 24*d* has an arcuate shape the center of which is the intersection P1.

Operation of the second embodiment will now be described.

When the swash plate-side transmission portion 19*b* is in contact with the movable body-side transmission portion 24*d*, the intersection P1 is not easily located outside the zone Z1, which is surrounded by the sliding portion 241*a*, in the axial direction of the rotary shaft 17. Thus, when the inclination angle of the swash plate 19 is changed, the moment that acts to tilt the movable body 24 with respect to the moving direction is reduced. This allows the inclination angle of the swash plate 19 to be changed smoothly.

Therefore, in addition to the advantages (1) to (4) and (6) of the first embodiment, the second embodiment achieves the following advantage.

(7) The movable body-side transmission portion 24*d* has an arcuate shape the center of which is the intersection P1. Even if the inclination angle of the swash plate 19 is changed, the intersection P1 is not easily located outside the zone Z1, which is surrounded by the sliding portion 241*a*, in the axial direction of the rotary shaft 17, as long as the swash plate-side transmission portion 19*b* is in contact with the movable body-side transmission portion 24*d*, which has an arcuate shape. Thus, when the inclination angle of the swash plate 19 is changed, the moment that acts to tilt the movable body 24 with respect to the moving direction is easily reduced. This allows the inclination angle of the swash plate 19 to be changed more smoothly.

Third Embodiment

A variable displacement swash plate type compressor according to a third embodiment will now be described with reference to FIG. 7.

Figure 7:
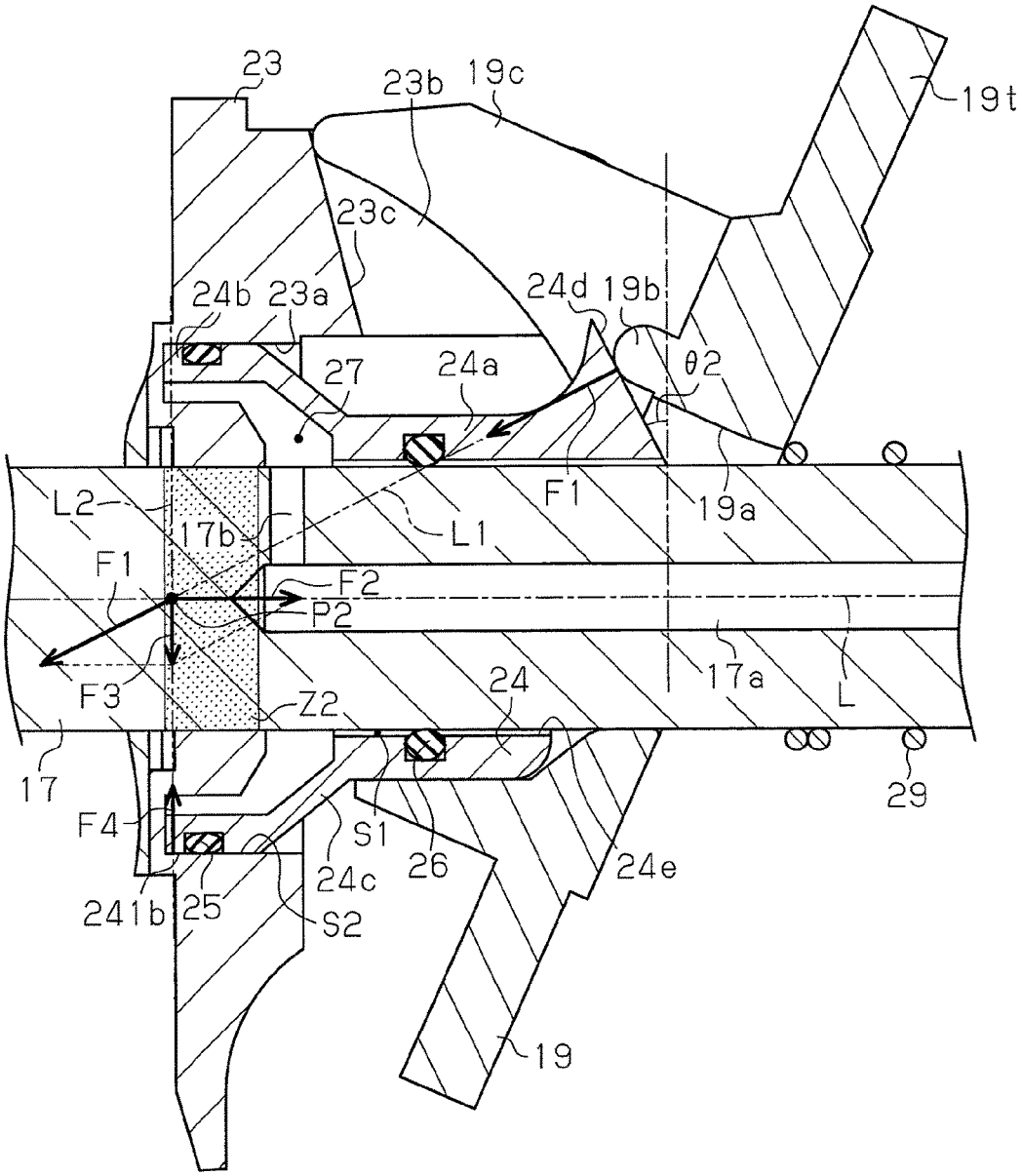
FIG. 7 is an enlarged cross-sectional side view illustrating a movable body and its surrounding when the inclination angle of a swash plate according to a third embodiment is maximized.

As shown in FIG. 7, the movable body 24 has a sliding portion 241*b*, which slides along the lug member 23 as the movable body 24 moves along the axis of the rotary shaft 17. The clearance S1 between the inner circumferential surface of the first cylindrical portion 24*a* and the rotary shaft 17 is larger than the clearance S2 between the outer circumferential surface of the second cylindrical portion 24*b* and the insertion recess 23*a*. Therefore, the sliding portion 241*b* is the outer circumferential surface of the second cylindrical portion 24*b* and extends along the axis of the rotary shaft 17.

The point at which the perpendicular line L1 to the movable body-side transmission portion 24*d* intersects the rotational axis L of the rotary shaft 17 as the inclination angle of the swash plate 19 changes is defined as an intersection P2. The perpendicular line L1 matches with the direction of a force F1 that is applied to the movable body-side transmission portion 24*d* by the swash plate-side transmission portion 19*b*. The inclination θ2 of the movable body-side transmission portion 24*d* is determined such that, when the inclination angle of the swash plate 19 is maximized, the intersection P2 is located in a zone Z2 surrounded by the sliding portion 241*b* when viewed in a direction that is perpendicular to the rotational axis L of the rotary shaft 17 and perpendicular to the first direction (that is, as viewed in the direction that is perpendicular to the sheet of FIG. 7 and directed away from the viewer). The inclination θ2 refers to an inclination with respect to the direction perpendicular to the axis of the rotary shaft 17.

Operation of the third embodiment will now be described.

The intersection P2 is located in the zone Z2 surrounded by the sliding portion 241*b*, at which the rotary shaft 17 and the movable body 24 slide on each other in the axial direction of the rotary shaft 17 as the inclination angle of the swash plate 19 changes. At this time, a resultant force is generated by combining the force F1, which is applied to the movable body-side transmission portion 24*d* by the swash plate-side transmission portion 19*b*, a force F2 that is generated by the pressure in the control pressure chamber 27 and acts to move the movable body 24 along the axis of the rotary shaft 17. The resultant force is defined as a resultant force F3. The resultant force F3 is generated on a vertical line L2 including the intersection P2, and a force F4 that is in the opposite direction and balances with the resultant force F3 is also generated on the vertical line L2. As a result, all the forces acting on the movable body 24 are generated on the vertical line L2, which includes the intersection P2, and balance out, and no moment is generated that acts to tilt the movable body 24 with respect to the moving direction. Thus, the inclination angle of the swash plate 19 is changed smoothly.

Therefore, the third embodiment achieves advantages equivalent to the advantages (1), (2), (5), and (6) of the first embodiment.

The above described embodiments may be modified as follows.

Figure 8:
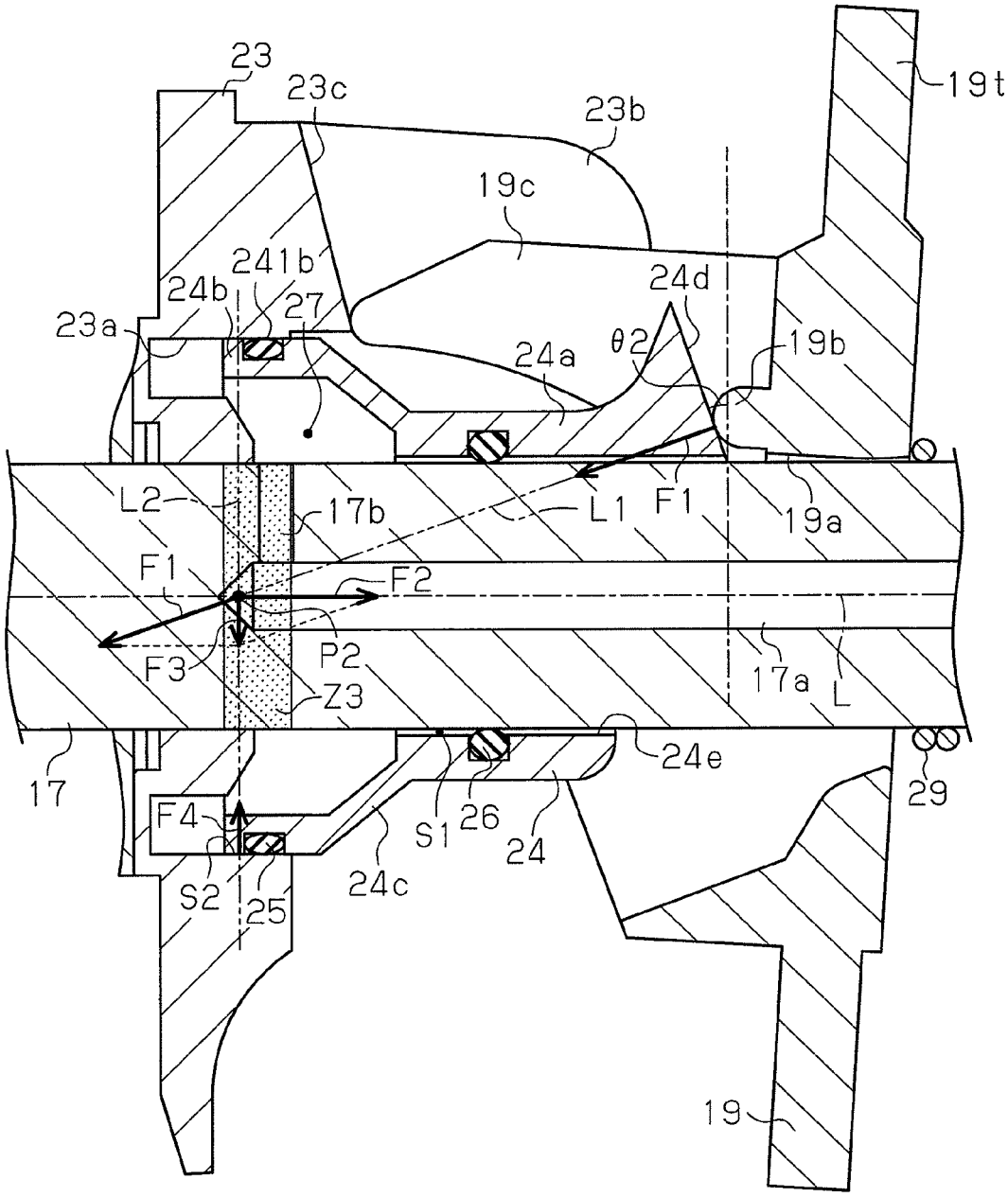
FIG. 8 is an enlarged cross-sectional side view illustrating a movable body and its surrounding when the inclination angle of a swash plate according to another embodiment is minimized.

In the third embodiment, the inclination angle θ2 of the movable body-side transmission portion 24*d* may be determined such that, when the swash plate 19 is at the minimum inclination as shown in FIG. 8, the intersection P2 is located in a zone Z3 surrounded by the sliding portion 241*b*. When the swash plate 19 is at the minimum inclination angle, the coupling portion 24*c* of the second cylindrical portion 24*b* is out of the insertion recess 23*a* of the lug member 23. Therefore, the inclination angle θ2 of the movable body-side transmission portion 24*d* is determined such that, when the swash plate 19 is at the minimum inclination, the intersection P2 is located in a zone Z3 surrounded by the sliding portion 241*b* in the axial direction of the rotary shaft 17.

Each of the above described embodiments may be modified as long as the intersections P1, P2 are located in the zones Z1, Z2, Z3 surrounded by the sliding portions 241*a*, 241*b* when the swash plate 19 is at the maximum inclination angle.

Each of the above described embodiments may be modified as long as the intersections P1, P2 are located in the zones Z1, Z2, Z3 surrounded by the sliding portions 241*a*, 241*b* when the swash plate 19 is at the minimum inclination angle.

Each of the above described embodiments may be modified as long as the intersections P1, P2 are located in the zones Z1, Z2, Z3 surrounded by the sliding portions 241*a*, 241*b* when the swash plate 19 is between the minimum inclination angle and the maximum inclination angle.

In each of the above described embodiments, the movable body-side transmission portion 24*d* may have a shape that is formed by combining a flat surface as in the first embodiment and an arcuate shape as in the second embodiment.

In each of the above described embodiments, the swash plate-side transmission portion 19*b* may be, for example, a columnar pin that is formed separately from the swash plate 19.

In the illustrated embodiments, drive power may be obtained from an external drive source via a clutch.

Therefore, the present examples and embodiments are to be considered as illustrative and not restrictive and the invention is not to be limited to the details given herein, but may be modified within the scope and equivalence of the appended claims.

The invention claimed is:

1. A variable displacement swash plate type compressor comprising:

a housing that has a suction chamber, a discharge chamber, a swash plate chamber communicating with the suction chamber, and a cylinder bore;

a rotary shaft that is rotationally supported by the housing and has a rotational axis;

a swash plate that is rotational in the swash plate chamber about the rotational axis of the rotary shaft by rotation of the rotary shaft;

a link mechanism that is arranged between the rotary shaft and the swash plate and allows change of an inclination angle of the swash plate with respect to a first direction that is perpendicular to the rotational axis of the rotary shaft;

a piston reciprocally received in the cylinder bore;

a conversion mechanism that causes the piston to reciprocate in the cylinder bore by a stroke corresponding to the inclination angle of the swash plate through rotation of the swash plate;

an actuator that is located in the swash plate chamber and configured to change the inclination angle; and a control mechanism that controls the actuator, wherein the link mechanism includes a lug member located in the swash plate chamber, wherein the lug member is fixed to the rotary shaft and faces the swash plate, and a swash plate arm that transmits rotation of the rotary shaft from the lug member to the swash plate, the actuator includes, a movable body located between the lug member and the swash plate, wherein the movable body moves in a direction in which the rotational axis of the rotary shaft extends, thereby changing the inclination angle, and a control pressure chamber defined by the lug member and the movable body, wherein the control pressure chamber uses an internal pressure thereof to move the movable body, the movable body includes a sliding portion that slides on the rotary shaft or on the lug member as the sliding portion moves in the direction in which the rotational axis of the rotary shaft extends, and a movable body-side transmission portion that engages with the swash plate at a position radially outward of the rotational axis of the rotary shaft, the swash plate includes a swash plate-side transmission portion that engages with the movable body-side transmission portion, and the movable body-side transmission portion is configured such that a perpendicular line or a normal to the movable body-side transmission portion and the rotational axis of the rotary shaft intersect with each other in a zone surrounded by the sliding portion when viewed in a direction that is perpendicular to the direction in which the rotational axis of the rotary shaft extends and perpendicular to the first direction.

2. The variable displacement swash plate type compressor according to claim 1, wherein the movable body-side transmission portion is configured such that, when the inclination angle of the swash plate is a maximum inclination angle, a perpendicular line or a normal to the movable body-side transmission portion and the rotational axis of the rotary shaft intersect with each other in a zone surrounded by the sliding portion when viewed in a direction that is perpendicular to the direction in which the rotational axis of the rotary shaft extends and perpendicular to the first direction.

3. The variable displacement swash plate type compressor according to claim 1, wherein the movable body-side transmission portion is configured such that, when the inclination angle of the swash plate is a minimum inclination angle, a perpendicular line or a normal to the movable body-side transmission portion and the rotational axis of the rotary shaft intersect with each other in a zone surrounded by the sliding portion when viewed in a direction that is perpendicular to the direction in which the rotational axis of the rotary shaft extends and perpendicular to the first direction.

4. The variable displacement swash plate type compressor according to claim 1, wherein the movable body-side transmission portion is configured such that, when the inclination angle of the swash plate is between a minimum inclination angle and a maximum inclination angle, a perpendicular line or a normal to the movable body-side transmission portion and the rotational axis of the rotary shaft intersect with each other in a zone surrounded by the sliding portion when viewed in a direction that is perpendicular to the direction in which the rotational axis of the rotary shaft extends and perpendicular to the first direction.

5. The variable displacement swash plate type compressor according to claim 1, wherein the movable body-side transmission portion is shaped as a linearly extending flat surface, which is inclined with respect to the moving direction of the movable body.

6. The variable displacement swash plate type compressor according to claim 1, wherein the movable body-side transmission portion has an arcuate shape having a center that is the intersection of the normal to the movable body-side transmission portion and the rotational axis of the rotary shaft.

7. The variable displacement swash plate type compressor according to claim 1, wherein the movable body includes a first cylindrical portion having an insertion hole into which the rotary shaft is inserted, a second cylindrical portion that extends in the axial direction of the rotary shaft and has a larger diameter than the first cylindrical portion, and a coupling portion, which couples the first cylindrical portion and the second cylindrical portion to each other, the lug member has an annular insertion recess into which a distal end of the second cylindrical portion is inserted, a clearance between an inner circumferential surface of the first cylindrical portion and the rotary shaft is set to be smaller than a clearance between an outer circumferential surface of the second cylindrical portion and the insertion recess, and the inner circumferential surface of the first cylindrical portion is the sliding portion.

8. The variable displacement swash plate type compressor according to claim 1, wherein the movable body includes a first cylindrical portion having an insertion hole into which the rotary shaft is inserted, a second cylindrical portion that extends in the axial direction of the rotary shaft and has a larger diameter than the first cylindrical portion, and a coupling portion, which couples the first cylindrical portion and the second cylindrical portion to each other, the lug member has an annular insertion recess into which a distal end of the second cylindrical portion is inserted, a clearance between an inner circumferential surface of the first cylindrical portion and the rotary shaft is set to be larger than a clearance between an outer circumferential surface of the second cylindrical portion and the insertion recess, and the outer circumferential surface of the second cylindrical portion is the sliding portion.

* * * * *